US007584806B2

(12) United States Patent
Weirich et al.

(10) Patent No.: US 7,584,806 B2
(45) Date of Patent: Sep. 8, 2009

(54) IMPLEMENT LIFT CYLINDER SUPPORT

(75) Inventors: Timothy J. Weirich, Morton, IL (US); Bradley W. Green, Peoria, IL (US); Wesley C. Reetz, East Peoria, IL (US); Carl D. Taylor, Canton, IL (US)

(73) Assignee: Caterpillar Inc., Peoria, IL (US)

( * ) Notice: Subject to any disclaimer, the term of this patent is extended or adjusted under 35 U.S.C. 154(b) by 307 days.

(21) Appl. No.: 11/182,439

(22) Filed: Jul. 15, 2005

(65) Prior Publication Data

US 2007/0012465 A1 Jan. 18, 2007

(51) Int. Cl.
*E02F 3/76* (2006.01)

(52) U.S. Cl. ..... 172/831; 172/812; 172/822

(58) Field of Classification Search ..... 172/819, 172/824, 825, 826, 827, 828, 829, 830, 831; 414/680

See application file for complete search history.

(56) References Cited

U.S. PATENT DOCUMENTS

| | | | | | |
|---|---|---|---|---|---|
| 2,756,065 | A | | 7/1956 | Schick | |
| 2,921,392 | A | | 1/1960 | Bidwell | |
| 2,927,385 | A | * | 3/1960 | Blomquist | 37/404 |
| 2,942,363 | A | * | 6/1960 | Long | 172/825 |
| 2,943,407 | A | | 7/1960 | Long | |
| 3,038,268 | A | * | 6/1962 | Vivier | 172/793 |
| 3,039,213 | A | * | 6/1962 | Allin, Jr. | 172/831 |
| 3,158,944 | A | * | 12/1964 | Hufeld et al. | 172/816 |
| 3,187,448 | A | * | 6/1965 | Kolinger | 172/826 |
| 3,222,804 | A | | 12/1965 | Kuhl | |
| 3,391,747 | A | * | 7/1968 | Long | 172/831 |
| 3,515,224 | A | * | 6/1970 | Seaberg | 172/812 |
| 3,572,446 | A | | 3/1971 | Mazzarins | |
| 3,608,322 | A | * | 9/1971 | Kinnan et al. | 405/182 |
| 3,897,833 | A | | 8/1975 | Frisbee et al. | |
| 4,023,625 | A | * | 5/1977 | Krolak et al. | 172/831 |
| 4,135,584 | A | | 1/1979 | Smith et al. | |
| 4,189,010 | A | | 2/1980 | Meisel, Jr. | |
| 4,413,555 | A | | 11/1983 | Swinney et al. | |

FOREIGN PATENT DOCUMENTS

| | | |
|---|---|---|
| EP | 0933748 | 8/1999 |
| GB | 676365 | 7/1952 |

* cited by examiner

*Primary Examiner*—Thomas B Will
*Assistant Examiner*—Joel F. Mitchell
(74) *Attorney, Agent, or Firm*—Mike King; Finnegan, Henderson, Farabow, Garrett & Dunner

(57) ABSTRACT

A support structure for an implement lift cylinder on an earth-working machine. The support structure includes first and second implement lift cylinder supports. The first implement lift cylinder support mounts to the work machine and the second implement lift cylinder support rotatably connects thereto about a first axis of rotation. The second implement lift cylinder support receives the implement lift cylinder and allows rotational movement thereof about a second axis of rotation. The first and second axes are located within a single plane. The dual axes provide stability and adjustability of the implement lift cylinder for different angle configurations of a work implement, such as an earth-working blade.

15 Claims, 3 Drawing Sheets

IMPLEMENT LIFT CYLINDER SUPPORT

TECHNICAL FIELD

This disclosure relates generally to an earth-working machine and, more particularly, to an implement lift cylinder support on the earth-working machine.

BACKGROUND

Various earth-working implements attached to tractors and other earth-working vehicles require movement in multiple axes. In particular, a dozing attachment, or blade, must be attached to the dozer so that an operator can raise, lower, or tilt the blade for proper angle and pitch configurations. These different configurations are necessary so that the dozing attachment may be positioned relative to the dozer to accomplish any desired landscaping or earth-working effect.

Typically, a push beam assembly and implement lift cylinders mounted on opposed sides of the dozer pivotally secure the dozing attachment to the dozer. Because the hydraulic cylinders experience much of the shifting of the dozing attachments, there have been several prior attempts to suitably mount the hydraulic cylinder to the dozer and the dozing attachment. For example, U.S. Pat. No. 3,897,833 to Claude M. Frisbee, granted on Aug. 5, 1975 discloses a trunnion mounting for an implement lift cylinder on an earth-working machine. The mounting includes a post with an inner race on a first end, which is rotationally maintained within an outer race of a sidewall of the earth-working machine by a plurality of bearing elements fitting in annular grooves on the inner and outer race. An implement lift cylinder is secured between a pair of mounts and bolted to a second end of the post.

The trunnion mounting discussed above suffers from at least four significant disadvantages. First, the inner and outer races include the annular complementary grooves that must be machined to very tight tolerances. The machining process is expensive, time consuming, and introduces additional manufacturing processes and handling, and thus increases overall manufacturing costs of the machine. Second, the post acting on the bearing elements provides a significant lever arm, which, under heavy loads, may result in increased wear and decreased component life. Third, the trunnion mount must be mounted to a side of the dozer, which may affect an operator's ability to view the area being worked. Fourth, the bearing elements are difficult to service. Well-lubed clean bearings are critical to bearing reliability and life. However, due to the tight machine requirements, disassembly may be difficult without moving the dozer to a maintenance facility with large hydraulic presses capable of separating the post from the bearing. As a result, down time and maintenance cause significant additional costs.

The disclosed implement lift cylinder support is directed to overcoming one or more of the problems set forth above.

SUMMARY OF THE INVENTION

In one aspect, an implement lift cylinder support for supporting a hydraulic cylinder is provided. The support includes a first implement lift cylinder support defining a first pair of axially aligned apertures, and a second implement lift cylinder support having a pair of posts extending into the first pair of axially aligned apertures. The second implement lift cylinder defines a second pair of axially aligned apertures configured to receive posts connected to the implement lift cylinder. The first pair of axially aligned apertures define a first axis of rotation, and the second pair of axially aligned apertures define a second axis of rotation. The first and second axes of rotation are located substantially within a plane.

In another aspect, the support includes first and second implement lift cylinder supports and first and second means for connecting the first and second implement lift cylinder supports. The second implement lift cylinder support connects to the first implement lift cylinder support and is adapted to receive an implement lift cylinder. The first means rotatably connects the second implement lift cylinder support to the first implement lift cylinder support, and the second means rotatably connects the implement lift cylinder to the second implement lift cylinder support. The first means allows the second implement lift cylinder to rotate about a first axis, and the second means allows the implement lift cylinder to rotate about a second axis. The first and second axes are located within a plane.

In yet another aspect, the support is adapted to connect to a mounting structure on a machine. The support includes a first implement lift cylinder support attached to the mounting structure, a second implement lift cylinder support rotatably connected to the first implement lift cylinder support about a first axis of rotation, and an implement lift cylinder rotatably connected to the second implement lift cylinder support about a second axis of rotation. The first axis of rotation and the second axis of rotation are located substantially within a plane.

It is to be understood that both the foregoing general description and the following detailed description are exemplary and explanatory only and are not restrictive of the invention.

BRIEF DESCRIPTION OF THE DRAWINGS

The accompanying drawings, which are incorporated in and constitute a part of this specification, illustrate exemplary embodiments of the invention and, together with the description, serve to explain the principles of the invention. In the drawings.

DETAILED DESCRIPTION

Reference will now be made in detail to embodiments of the invention, examples of which are illustrated in the accompanying drawings.

Figure 1:
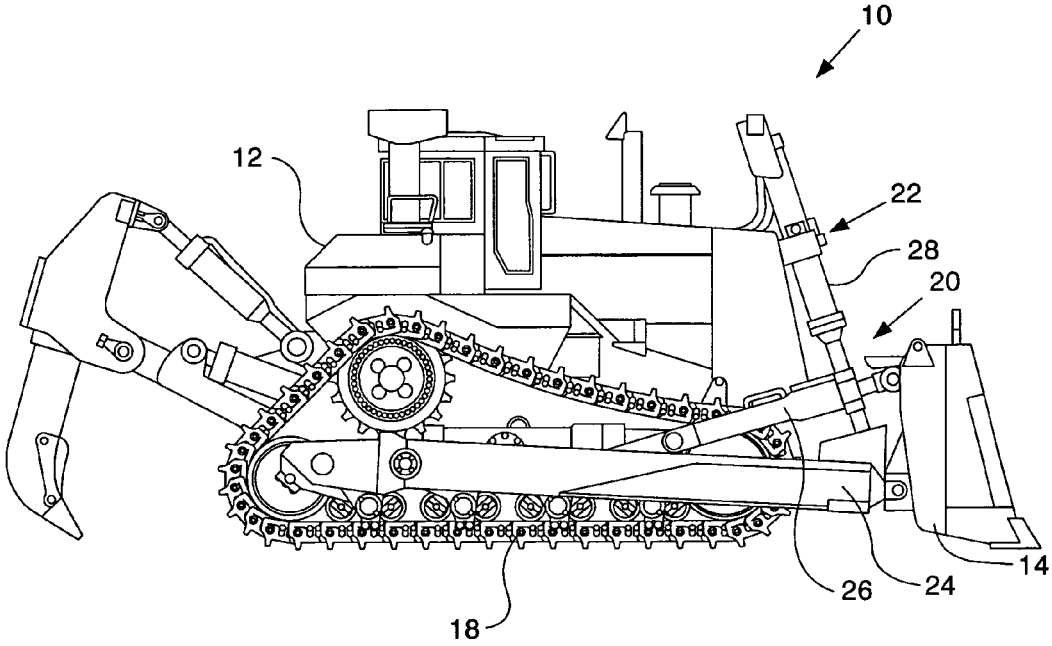
FIG. 1 illustrates an earth-working machine having an implement lift cylinder support.

FIG. 1 illustrates an exemplary work machine 10. The work machine 10 may be a fixed or mobile machine that performs some type of operation associated with an industry such as mining, construction, or farming, for example. The work machine 10 may be a dozer, as illustrated, an excavator, a harvester, a backhoe, or other work machine. The work machine 10 includes a machine body 12 and at least one work implement 14 movably connected to the machine body 12.

The machine body 12 may include any structural unit that supports movement of the work machine 10 and/or the work implement 14. The machine body 12 may include, for example, a stationary base frame (not shown) connecting a power source (not shown) to a traction device 18.

The work implement 14 may include any device used in the performance of a task. For example, the work implement 14 may include a blade, a bucket, a shovel, a hammer, an auger, a ripper, or any other task-performing device known in the art.

Work implement 14 may be configured to pivot, rotate, slide, swing, or move relative to the machine body 12 in any other manner known in the art.

The work implement 14 may be movably connected to the machine body 12 by, for example, a linkage system 20 known in the art. Specifically, the work implement 14 may be connected to the machine body 12 by way of support structure 22, push arms 24, and tilt arms 26.

The linkage system 20 may be movable by a plurality of hydraulic cylinders. In particular, an implement lift cylinder 28 may be expandable and retractable to move the work implement 14 downward and upward relative to a working surface. A hydraulic cylinder may further be adapted to move the push arms 24 to angle the work implement 14 relative to the machine body 12. The tilt arms 26 may be adapted to tilt the work implement relative to the machine body 12. Finally, additional hydraulic cylinders may be attached to the work machine 10, machine body 12, and additional work implements to move the additional work implements as desired.

Figure 2:
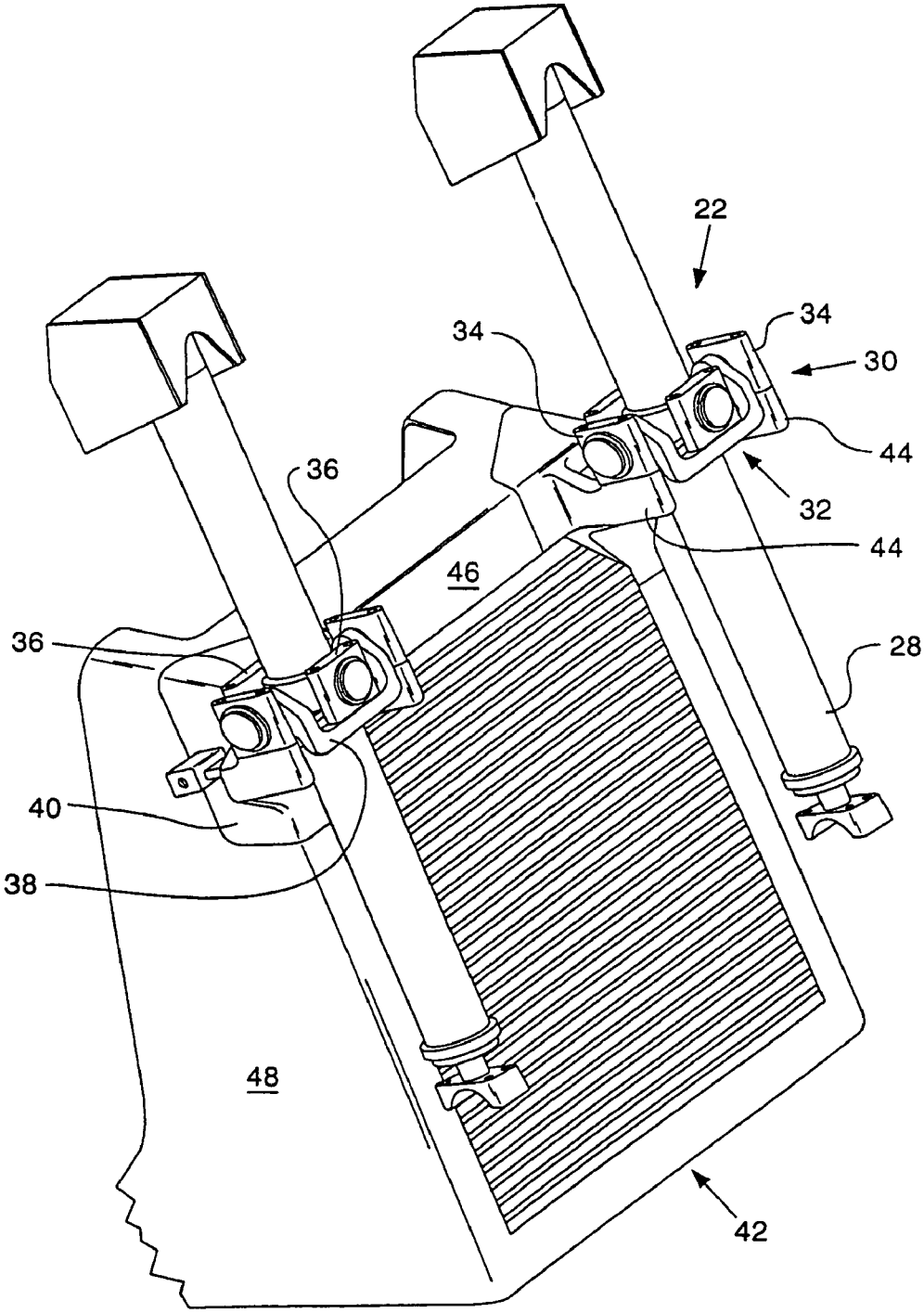
FIG. 2 illustrates a perspective view of an implement lift cylinder support.

Referring now to FIG. 2, the support structure 22 includes a first implement lift cylinder support 30 and a second implement lift cylinder support 32 rotatably connected thereto.

The first implement lift cylinder support 30 includes a first pair of opposed mounts 34 and the second implement lift cylinder support 32 includes a second pair of opposed mounts 36 connected to a frame 38.

Fasteners, such as bolts, connect the first and second pair of opposed mounts 34 and 36 to a mounting structure 40 and the frame 38, respectively. The mounting structure 40 is integrally attached to the earth-working machine 10. The mounting structure 40 may be cast integral to a front end casting 42 of the earth-working machine 10 to form a single integral piece or individually cast and secured to the front end casting 42 during assembly. The mounting structure 40 includes a pair of extensions 44 that attach to and extend outwardly from a front surface 46 of the earth-working machine 10. However, the extensions 44, or mounting structure 40, may be positioned to attach to any surface of the earth-working machine 10. For example, the extensions 44 or the mounting structure 40 may attach to and extend outwardly from a side surface 48 of the front end casting 42.

Figure 3:
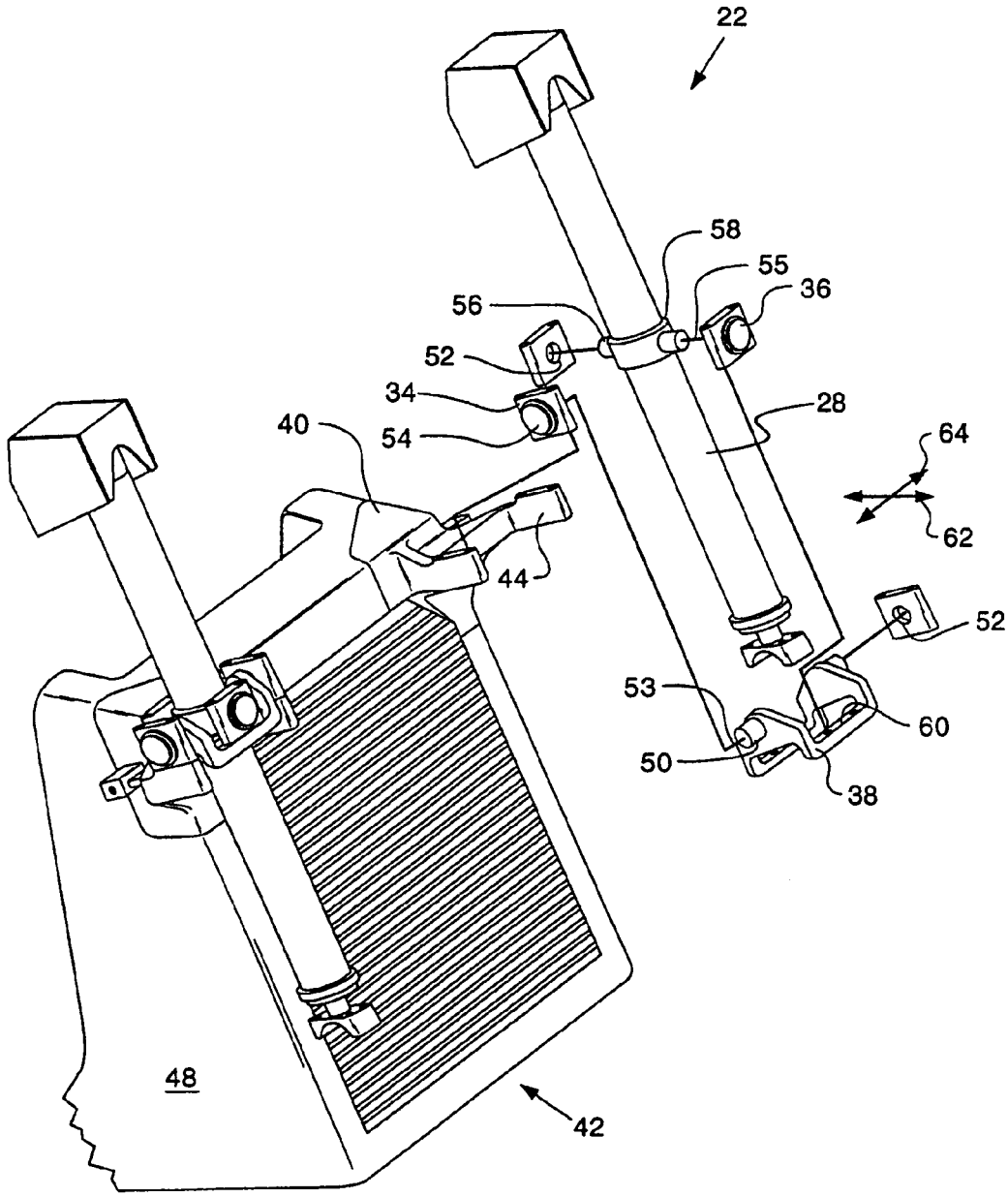
FIG. 3 illustrates an exploded view of an implement lift cylinder support.

Referring now to FIG. 3, each of the first and second pairs of opposed mounts 34 and 36 define apertures 52 therein. The defined apertures 52 provide first and second axes of rotation 53 and 55. The second implement lift support 32 rotates about the first axis of rotation 53 and the implement lift cylinder 28 rotates about the second axis of rotation 55. Preferably, the first and second axes of rotation 53 and 55 run substantially perpendicular to each other, and are located on a single plane.

The defined apertures 52 may be fitted with sleeve bearings or bushings (not shown) to improve rotational movement of the frame 38 and the implement lift cylinder 28 while in operation. The defined apertures 52 may also be fitted with seals (not shown) to maintain proper lubrication of the interconnecting frame and ring posts 50 and 56 within the defined apertures 52. Caps, or seals, 54 may be fit to cover the defined apertures 52 to prevent entrainment of undesirable particles, such as dirt, while in operation.

Frame posts 50 attach to and extend from the frame 38, and ring posts 56 attach to and extend from an implement lift cylinder ring 58. A weld secures the implement lift cylinder ring 58 to the implement lift cylinder 28. One skilled in the art will recognize that the implement lift cylinder ring 58 may be attached to the implement lift cylinder using other well known techniques.

Optionally, the frame and ring posts 50 and 56 may be internally threaded to accept bolts (not shown) to secure the first pair of opposed mounts 34 to the frame 38 and the second pair of opposed mounts 36 to the ring posts 56. Alternative means of securing the bolts to the posts 56, and still allow rotational movement of the frame 38 and the implement lift cylinder 28, that are known to those having ordinary skill, may be employed.

It is noted that that the placement of the defined apertures 52 and frame and ring posts 50 and 56 may be reversed. For example, the defined apertures 52 may be positioned on the implement lift cylinder ring 58 and the frame 38, and the frame and ring posts 50 and 56 may be positioned on the first and second opposed mounts 34 and 36.

The frame 38 features lowered fore-aft positions 60 for receiving the second pair of opposed mounts 36 to maintain a compact design.

INDUSTRIAL APPLICABILITY

The support structure 22 supports the implement lift cylinder 28 to prevent axial forces acting against the implement lift cylinder 28 from causing significant unintended movement while allowing the implement lift cylinder 28 desirable side-to-side and fore-aft movement.

In operation, and referring back to FIGS. 1-3, the support structure 22 attaches to the front of the work machine 10. The frame posts 50 rotate about the first axis 53 within the defined apertures 52 of the first pair of opposed mounts 34 and allow fore-aft movement of the implement lift cylinder 28 in direction of arrow 62. The ring posts 56 rotate about the second axis 55 within the defined apertures 52 of the second pair of opposed mounts 36 and allow side-to-side movement of the implement lift cylinder 28 in direction of arrow 64. Other connecting means, such as ball and sockets, universal joints, hinges, and other rotatable components may be used to provide the desired rotation.

When an operator of the work machine 10 adjusts the angle and tilt of the work implement 14, the implement lift cylinders 28 rotate about the first and second axes 53 and 55. Specifically, the ring posts 56 rotate about the defined apertures 52 of the second opposed mounts 36 and the frame posts 50 rotate about the defined apertures 52 of the first pair of opposed mounts 34.

It will be apparent to those skilled in the art that various modifications and variations can be made to the support of the present disclosure. Other embodiments of the support will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. An implement lift cylinder support for supporting a hydraulic cylinder, comprising:

a first implement lift cylinder support defining a first pair of axially aligned apertures; and a second implement lift cylinder support having a pair of posts extending into the first pair of axially aligned apertures, the second implement lift cylinder support defining a second pair of axially aligned apertures configured to receive posts connected to the implement lift cylinder;

wherein the first pair of axially aligned apertures defines a first axis of rotation, and the second pair of axially aligned apertures defines a second axis of rotation, and wherein the first and second axes of rotation are located within a plane.

2. The support of claim 1, wherein the first implement lift cylinder support comprises a first pair of opposed mounts and the second implement lift cylinder support comprises a second pair of opposed mounts attached to a frame.

3. The support of claim 2, wherein the posts of the second implement lift cylinder support are connected to the frame and extend into the apertures of the first pair of opposed mounts.

4. The support of claim 2, further comprising bearings inserted into the apertures of at least one of the first or second pair of the opposed mounts.

5. The support of claim 1, wherein the second axis of rotation runs substantially perpendicular to the first axis of rotation.

6. The support of claim 1, wherein the irst implement lift cylinder support comprises a pair of opposed mounts removably attached to a pair of extensions, the extensions configured to attach to a machine on which the implement lift cylinder support supports the hydraulic cylinder.

7. An implement lift cylinder support comprising:

a first implement lift cylinder support configured to attach to a machine;

a second implement lift cylinder support connected to the first implement lift cylinder support and configured to receive an implement lift cylinder;

a first means for rotatably connecting the second implement lift cylinder support to the first implement lift cylinder support;

a second means for rotatably connecting the implement lift cylinder to the second implement lift cylinder support;

wherein the first means allows the implement lift cylinder to rotate about a first axis, and the second means allows the implement lift cylinder to rotate about a second axis, and wherein the first and second axes are located within a plane, wherein the first implement lift cylinder support comprises a first pair of opposed mounts and the second implement lift cylinder support comprises a second pair of opposed mounts attached to a frame, wherein the first and second opposed mounts define apertures, and the first and second means include a pair of posts, which extend into the defined apertures of the first and second pair of opposed mounts, respectively.

8. The support claim 7, wherein the first and second means comprise a ball joint.

9. The support of claim 7, further comprising hearings inserted into the defined apertures, and wherein the posts fit within the bearings.

10. The support of claim 7, wherein the second axis of rotation runs substantially perpendicular to the first axis of rotation.

11. An implement lift cylinder support on a machine, comprising:

a mounting structure;

a first implement lift cylinder support attached to the mounting structure;

a second implement lift cylinder support rotatably connected to the first implement lift cylinder support about a first axis of rotation;

an implement lift cylinder rotatably connected to the second implement lift cylinder support about a second axis of rotation; and wherein the first axis of rotation and the second axis of rotation are located within a planes;

a first means for connecting the second implement lift cylinder support to the first implement lift cylinder support; and a second means for connecting the implement lift cylinder to the second implement lift cylinder support, wherein the first and second me each define a pair of apertures and include a pair of posts configured to fit within the apertures.

12. The support of claim 11, wherein the first implement lift cylinder support comprises a first pair of opposed mounts and the second implement lift cylinder support comprises a second pair of opposed mounts attached to said first means, which rotatably attaches to the first pair of opposed mounts.

13. The support of claim 11, further comprising bearings inserted into the defined apertures of at least one of the first or second pair of opposed mounts.

14. The support of claim 11, wherein the second axis of rotation runs substantially perpendicular to the first axis of rotation.

15. The support of claim 11, wherein the first implement lift cylinder support attaches to the pair of costs of the second means.

* * * * *